United States Patent [19]

Kamberg

[11] Patent Number: 4,809,674

[45] Date of Patent: Mar. 7, 1989

[54] HEATER FOR FLATWORK FINISHER

[75] Inventor: Eduard Kamberg, Chicago, Ill.

[73] Assignee: New Super Laundry Machinery Co., Inc., Chicago, Ill.

[21] Appl. No.: 575,184

[22] Filed: Jan. 30, 1984

[51] Int. Cl.[4] ..... D06F 67/00

[52] U.S. Cl. ..... 126/410; 126/401; 431/353

[58] Field of Search ..... 431/353; 126/401, 410, 126/407, 408, 409, 411; 38/8, 1 A, 1 R, 49, 53, 69, 100, 101

[56] References Cited

U.S. PATENT DOCUMENTS

| | | | |
|---|---|---|---|
| 91,095 | 6/1869 | Desloge | 126/410 |
| 934,733 | 9/1909 | Jorgensen | 38/101 |
| 1,634,353 | 7/1927 | Frantz | 38/49 |
| 1,781,798 | 11/1930 | Williams | 126/410 |
| 1,945,273 | 1/1934 | Hetzer | 126/410 |
| 1,984,879 | 12/1934 | Johnson | 126/401 |
| 2,005,801 | 6/1935 | Olsen | 431/353 |
| 2,239,572 | 4/1941 | Richa | 38/1 R |
| 2,559,979 | 7/1951 | Martois | 126/39 H |
| 2,599,486 | 6/1952 | Rose | 38/1 R |
| 2,836,910 | 7/1958 | Kinzelman | 38/49 |
| 4,197,663 | 4/1980 | Riedel | 38/49 |

FOREIGN PATENT DOCUMENTS

| | | | |
|---|---|---|---|
| 409754 | 4/1910 | France | 126/410 |

*Primary Examiner*—Margaret A. Focarino

[57] ABSTRACT

This invention relates to industrial type flatwork finishers in the form of roller type ironers employing a revolving cylinder that is internally heated by means of an atomospheric type burner fueled by combustible gases. The industrial ironer requires a cylinder approximately 12 inches in diameter and up to 110 inches in length. The internal heating means provide a plurality of burner tips in a prearranged relation to interior surface of the cylinder for uniformally heating the same.

2 Claims, 2 Drawing Sheets

HEATER FOR FLATWORK FINISHER

SUMMARY OF THE INVENTION

In prior art apparatuses of this character the most acceptable means of heating the revolving cylinder is combustible gases, due to the fact that many machines are installed in situ that do not have high pressure steam available. Until now in order to have a gas burner operate efficiently in a long machine such as the type of this invention it was necessary to use a power type burner which included a combustible blower and a device for pre-mixing gas and air. In addition to this, complex controls were required to monitor the various functions of the separate elements of the combustion means.

It is the object of this invention to provide a specifically constructed heater that includes an atmospheric type burner whereby the rotating cylinderical ironer is heated uniformally throughout its length.

A further object of this invention is to provide in an industrial flatwork finisher a revolving cylinder ironer that is uniformly internally heated without the necessity of complex controls and regulators.

Yet a further object of this invention is to provide in an industrial flatwork finisher a system for heating a small cylinderical ironer of a relatively expanded length which is highly efficient in use and economical to manufacture.

Other objects will appear hereinafter.

BRIEF DESCRIPTION OF THE DRAWINGS

The invention will be best understood by reference to the accompanying drawings which illustrate the preferred mode of construction by which the stated objects of the invention are achieved, and in which.

GENERAL DESCRIPTION

Figure 1:
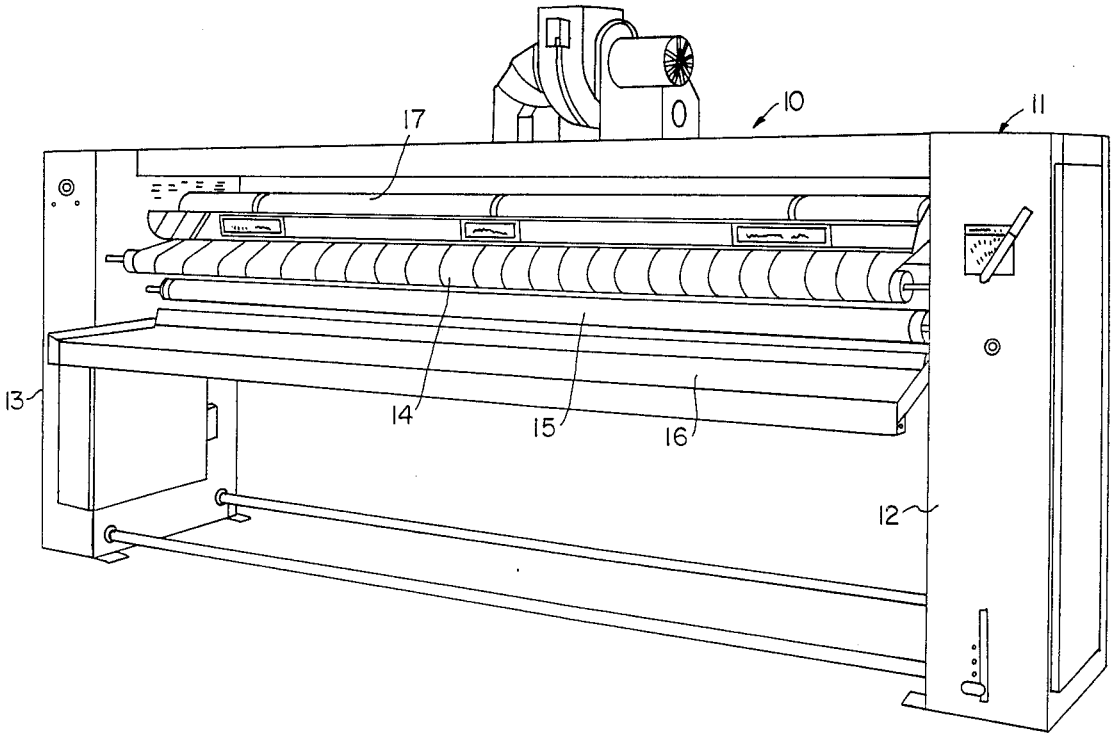
FIG. 1 is a perspective view of an industrial type flatwork finisher embodying this invention.

The specific invention is adapted to be included in a industrial type flatwork finisher identified by numeral 10 in FIG. 1. The finisher 10 includes a free standing frame 11 consisting of side panels 12 and 13 that support therebetween a feeding conveyor 14, a return conveyor 15 and a recovery shelf 16. Within the confines of the frame there is a heated cylinder which cooperates with a padded roller 17 to accomplish the ironing or finishing function to the flatwork.

Figures 2, 3:
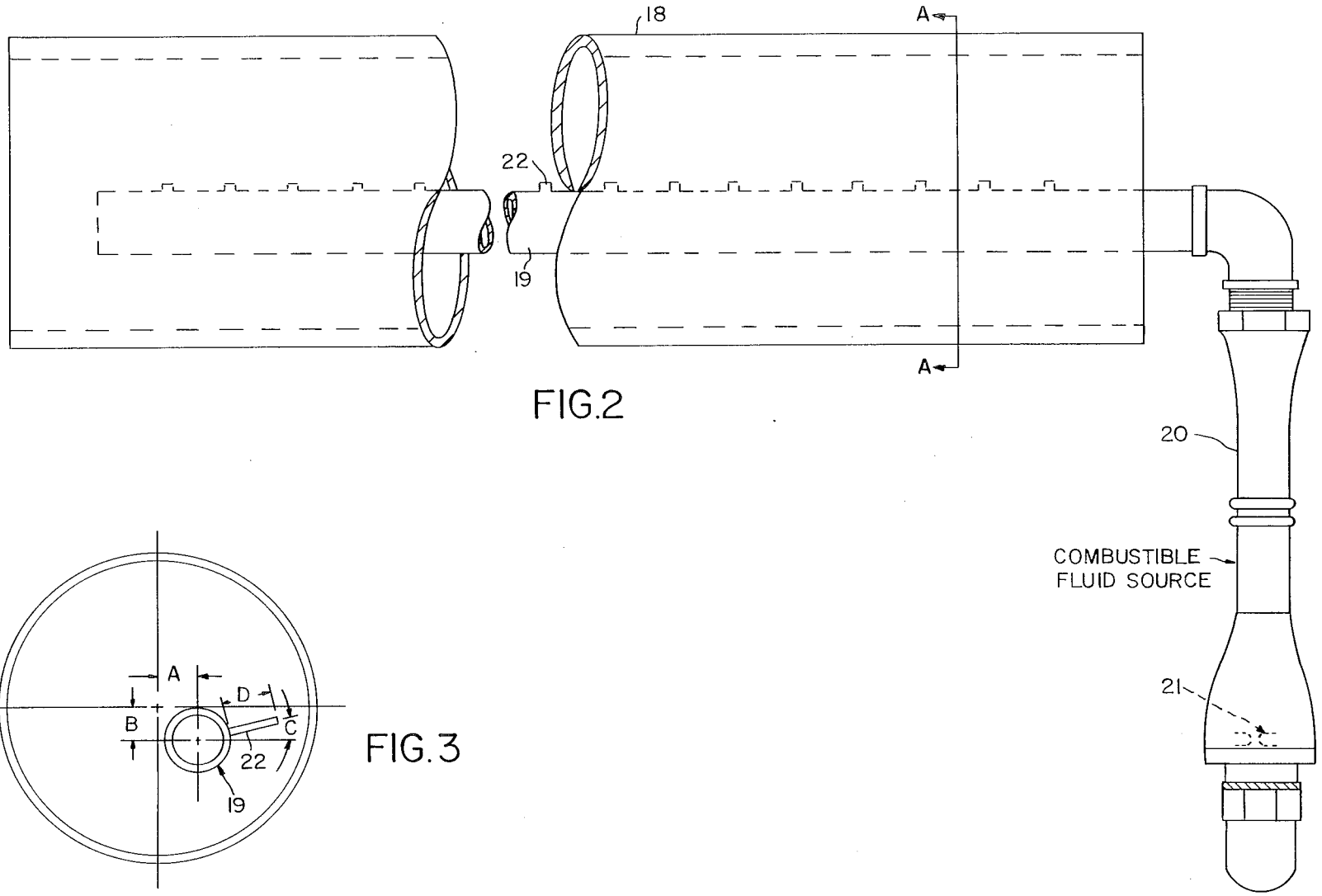
FIG. 2 is a fragmentary detailed sectional view of the cylinderical roller type ironer and heater unit.
FIG. 3 is a end elevational view of the heater and cylinderical ironer of this invention.

As illustrated in FIG. 2 the heated cylinder 18 is shown as housing a burner 19. The necessary journal supports for the cylinder 18 are not shown as these components are of well known construction. The burner 19 is connected to a combustible fluid feed line 20 which contains an internal mixer or orifice 21, again of a well known construction.

As shown the burner 19 extends coaxially of the cylinder 18 substantially throughout its length. It is important to note that this invention is especially adapted for use in finisher constructions that employ small cylinders, in the range of 12 inch diameters, and extended lengths of up to 110 inches.

Throughout the length of the burner 19 there are provided a plurality of burner tips 22. It has been found that the most effective heat distribution is obtained when the burner tips 22 are spaced on 2 inch centers.

To perfect proper heat distribution upon the inner rotating wall surface of the cylinder 18 it has been found that the burner 19 be located in a radially offset plane with respect to the imaginary center axis of the cylinder 18.

The location of the burner 19 is best illustrated in the FIG. 3 where its center axis 23 is located to the right of the imaginary center axis 24 of the cylinder 18 a distance indicated as at "A" as well as below such point, a distance indicated at "B". It is also to be noted that the burner tips 22 are inclined from the longitudinal axis of the burner 19 by at least 15 degrees as indicated at "C".

In a 12 inch cylinder 18, the burner 19, should have a diameter of approximately 2 inches and the angularly disposed burner tips 22 should have a length of approximately $1\frac{1}{2}$ inches. as indicated at "D".

As a result of the arrangement of parts as here and before described the revolving cylinder 18 will be heated uniformly throughout its length.

The angularly disposed burner tips 22 permit the ignited gases to strike the revolving inner surface of the cylinder 18 in a brushlike manner, with the heat generated therefrom spread over a designated area.

With the burner tips being spaced on 2 inch centers the heated brushlike areas adjoin the entire inner surface of the cylinder 18. In the past heater units were placed so that the ends of the ignited gases touched directly upon a designated spot and thus did not uniformly heat the cylinder as required.

While I have illustrated and described the preferred form of construction for carrying out my invention, this is capable of variation and modification without departing from the spirit of the invention. I, therefore, do not wish to be limited to the precise details of construction as set forth, but desire to avail myself of such variations and modifications as come within the scope of the appended claims.

Having thus described my invention, what I claim as new and novel and desire to protect by Letters Patent is:

1. An industrial type internally heated flatwork finisher wherein the improvement comprises;

(a) an elongated cylinder rotatable about its center axis, (b) a gas burner comprising an elongated pipe positioned within said cylinder with its longitudinal axis extending parallelly beneath and to one side of the center axis of said cylinder so as to be offset with respect thereto, (c) a series of burner tips radially extending from the periphery of said burner with their free ends extending obliquely to the inner surface of said cylinder in the direction of its rotation about its center axis, and (d) a source of combustible fluid for said burner.

2. An industrial type internally heated flatwork finisher as defined by claim 1 wherein said pipe has a diameter not exceeding 2 inches and said burner tips have a length not exceeding an inch and a half with said burner tips located on 2 inch centers throughout the length of said pipe.

* * * * *